US012781591B2

(12) United States Patent
Moreira et al.

(10) Patent No.: US 12,781,591 B2
(45) Date of Patent: Nov. 3, 2026

(54) METHOD FOR CEMENTATION IN CARBONATE ROCKS UNDER SEVERE CIRCULATION LOSS CONDITIONS

(71) Applicant: PETROLEO BRASILEIRO S.A.—PETROBRAS, Rio de Janeiro (BR)

(72) Inventors: Rafael Peralta Muniz Moreira, Rio de Janeiro (BR); Thiago Da Silva Piedade, Macae (BR)

(73) Assignee: PETROLEO BRASILEIRO S.A.—PETROBRAS, Rio de Janeiro (BR)

( * ) Notice: Subject to any disclaimer, the term of this patent is extended or adjusted under 35 U.S.C. 154(b) by 0 days.

(21) Appl. No.: 19/265,750

(22) Filed: Jul. 10, 2025

(65) Prior Publication Data

US 2026/0022619 A1 Jan. 22, 2026

(30) Foreign Application Priority Data

Jul. 22, 2024 (BR) ..... 1020240149718

(51) Int. Cl.
*E21B 33/14* (2006.01)
*E21B 33/13* (2006.01)

(52) U.S. Cl.
CPC ..... *E21B 33/14* (2013.01); *E21B 33/13* (2013.01)

(58) Field of Classification Search
CPC ..... E21B 33/14; E21B 33/13; E21B 33/00; E21B 33/10
See application file for complete search history.

(56) References Cited

U.S. PATENT DOCUMENTS 8,401,795 B2 3/2013 Kaageson-Loe et al.
8,418,764 B2 * 4/2013 Dusterhoft ..... C09K 8/575 166/305.1
8,935,957 B2 * 1/2015 Kulkarni ..... C09K 8/50 73/152.04
2015/0361760 A1 * 12/2015 McClung, III ..... H05B 6/6491 166/293

(Continued)

FOREIGN PATENT DOCUMENTS

CA 2541318 C * 1/2011 ..... E21B 17/18
CN 106555565 A * 4/2017 ..... E21B 33/13

(Continued)

OTHER PUBLICATIONS

Brandl et al. (2014), "Combating Severe Losses and Improving Cementing Quality in Carbonate Formations: A Lesson Learned from Drilling Wells in Offshore Sarawak, Malaysia", IADC/SPE Asia Pacific Drilling Technology Conference, IADC/SPE-170501-MS, 1-10.

(Continued)

*Primary Examiner* — Daniel P Stephenson
(74) *Attorney, Agent, or Firm* — RAPHAEL BELLUM PLLC

(57) ABSTRACT

The disclosure relates to a method for cementing in carbonate rocks under severe circulation loss conditions. In the planning and execution of these wells, contingency cementing corrections have therefore proven to be the most cost-effective alternative due to the vast majority of successful cementing quality results.

6 Claims, 4 Drawing Sheets

(56) References Cited

U.S. PATENT DOCUMENTS

| | | | | |
|---|---|---|---|---|
| 2021/0101833 | A1* | 4/2021 | Thaemlitz | C04B 38/103 |
| 2022/0010651 | A1* | 1/2022 | Egbe | E21B 33/138 |

FOREIGN PATENT DOCUMENTS

| | | | | |
|---|---|---|---|---|
| WO | WO-2016163996 | A1 * | 10/2016 | E21B 33/138 |
| WO | WO-2022095150 | A1 * | 5/2022 | G01N 33/00 |

OTHER PUBLICATIONS

Fidan et al. (2004), "Use of Cement as Lost-Circulation Material: Best Practices", Canadian International Petroleum Conference, Paper 2004-090, 1-11.

Filho (2018), "Pastas de Cimento Para Aplicacao em Pocos de Petroleo com Zonas Fraturadas", Tese de Doutorado, Universidade Federal do Rio Grande do Norte Centro de Tecnologia Departamento de Engenharia Quimica Programa de Pos-Graduacao em Engenharia Quimica, 1-110.

Ravi et al. (2006), "Cementing Technology for Low Fracture Gradient and Controlling Loss Circulation", SPE/IADC Indian Drilling Technology Conference and Exhibition, SPE/IADC 102074, 1-9.

Yousuf et al. (2021), "A comprehensive review on the loss of wellbore integrity due to cement failure and available remedial methods", Journal of Petroleum Science and Engineering, 207, 109123, 1-16.

* cited by examiner

A

| Displacement efficiency | |
|---|---|
| Time (min) | Fluid displacement (%) |
| 2 | 66.7 |
| 5 | 78.8 |
| 7 | 100.0 |
| 10 | 100.0 |

Spacer with no LCM

| Displacement efficiency | |
|---|---|
| Time (min) | Fluid displacement (%) |
| 2 | 100.0 |
| 5 | 100.0 |
| 7 | 100.0 |
| 10 | 100.0 |

Spacer with LCM

B

| Displacement efficiency | |
|---|---|
| Time (min) | Fluid displacement (%) |
| 2 | 78,8 |
| 5 | 100,0 |
| 7 | 100,0 |
| 10 | 100,0 |

Spacer with no LCM

| Displacement efficiency | |
|---|---|
| Time (min) | Fluid displacement (%) |
| 2 | 100,0 |
| 5 | 100,0 |
| 7 | 100,0 |
| 10 | 100,0 |

Spacer with LCM

Figure 4

METHOD FOR CEMENTATION IN CARBONATE ROCKS UNDER SEVERE CIRCULATION LOSS CONDITIONS

CROSS-REFERENCE TO RELATED APPLICATION(S) AND CLAIM OF PRIORITY

This application claims the benefit of priority of application Ser. No. 1020240149718, filed in Brazil on Jul. 22, 2024; the complete disclosure of which is incorporated herein by reference.

FIELD

The disclosure falls within the field of Well Drilling and Completion, more specifically in the field of Cementation in Carbonate Rocks and refers to a method for cementing carbonate rocks under severe circulation loss conditions.

BACKGROUND

The pre-salt carbonate reservoirs of the Santos Basin present challenging characteristics for oil well cementing, including a narrow operational window resulting from the presence of natural fractures. The oil industry has adopted various actions to address the causes of loss of circulation in cementing operations, such as combating loss prior to casing running, using liner configurations (casing with the top below the wellhead) with a tie-back (casing complement from the top of a Liner), MPC (Managed Pressured Cementing) and the like. However, there has been limited experience/effectiveness in the industry in implementing cementing quality control under conditions where circulation losses cannot be prevented or eliminated during cementing operations in carbonate rocks.

It is worth noting that at the beginning of the exploration and development of wells that penetrate carbonate rocks, the most commonly used casing configuration was a liner, in order to achieve lower Equivalent Circulating Density (ECD) during casing run and cementing. In fact, liner cementing offers some advantages over a full casing, such as reduced load losses (reduced ECD) and greater ease of remediation through top squeeze operations. Therefore, this configuration presents a greater likelihood of achieving success in cementation. The main disadvantage is the increased time for construction of the well, which may reach up to 7 days due to the need for a production casing tie back. Further disadvantages are associated with increased operational complexity and risks due to the use of additional equipment and the presence of cement above the setting tool.

Another technique commonly used in the industry is to prevent loss prior to casing running. Prevention of losses using cement plugs or other sealing materials is often employed for casing running. With very few exceptions, in wells where they are used, the loss recurred during casing running and/or cementing. The technique for preventing losses using balanced cement plugs (Wellbore Strengthening) has been implemented in 6 wells with ineffective results in 4 of them. This practice typically requires an added average time of 3 days to the wellbore construction, considering the sum of plugging and cement cutting operations. And all this for a technique that has demonstrated a low success rate. The use of a special slurry system for lightweight slurries, such as proprietary blends, has been tested in 2 wells but yielded results significantly below expectations. In addition to failing to fully mitigate circulation losses, which occur regardless of the slurry weight, the difficulties in assessing the cementation of lightweight slurries proved to be a critical obstacle, since cement evaluation is generally performed 2 days after completion of cementation. A full casing configuration with a conventional slurry system that provides reduced wellbore construction time, while ensuring good and consistent cementation under severe loss conditions was the solution sought and developed by Petrobras.

Therefore, there was a need to develop practices that had not been used so far, so that the top of cement could be satisfactorily reached in a full casing operation. Although it is impossible to predict the top of cement depth with the same precision as in cases with no lost circulation—as part of the cement volume will be lost to the formation and will prevent the loss during primary cementation. This excess volume must be estimated based on the magnitude of the observed losses, the extent of the exposed formation, among other factors. Even under lost circulation conditions, the slurry placement flow rates should remain high to maximize fluid displacement by the spacers and slurry. The benefits of reducing ECD (an about 500 psi drop for a 50% reduction in the flow rate) are minimal when compared to the damage caused by a poor fluid displacement, since a top of cement below the expected can be relatively simple to correct, whereas a contaminated or channeled cementation may be economically or technically unfeasible to remediate.

Each specific scenario may require a specific flow rate program design, depending on the amount of loss, wellbore washout (which reduces the speed of fluids in the annulus).

STATE OF THE ART

Document U.S. Pat. No. 8,401,795B2 refers to a method for planning a wellbore, the method including defining drilling data for drilling a segment of a planned wellbore and identifying a risk zone in the segment. Additionally, the method includes determining an expected fluid loss for the risk zone and selecting a solution to reduce fluid loss in the risk zone. Furthermore, the invention related to a method for treating drilling fluid loss at a drilling location, the method including calculating a drilling fluid loss rate at the drilling location, classifying the drilling fluid loss based on the drilling fluid loss rate, and selecting a solution based at least in part on the classifying.

The document to Brandl et al., entitled "*Combating Severe Losses and Improving Cementing Quality in Carbonate Formations: A Lesson Learned from Drilling Wells in Offshore Sarawak, Malaysia*", discusses a unique design technique for curing the challenging lost circulation issues while also providing improved cement placement along the fractured formation. The engineered solution was the use of a cement spacer fluid containing membrane forming colloids to seal fracture sizes up to 2 mm which also yielded 100% return permeability to hydrocarbons. The use of the spacer fluid enabled successful cement placement along the critical carbonate section.

The document to Fidan & Kuru, entitled "*Use of Cement as Lost-Circulation Material: Best Practices*", refers to the best practices for the use of cement as a lost circulation material. It is found that different types of fluids are recommended to perform successful primary cementing applications when loss of circulation is a threat to cementing a casing string at the desired depths. Furthermore, oil-based fluids when in contact with the cement are known to delay and change the slurry properties to such an extent that the cement may no longer harden within the desired timeframe.

The spacer package is as important, if not more so, than the cement blend itself when trying to cure losses in oil-wet open-hole environments.

The document to Filho, entitled "*Pastas de Cimento para Aplicação em Poços de Petróleo com Zonas Fraturadas*", refers to cement slurries for application in oil wells having fractured zones. Statistical plans were made to determine the best cement slurry that could be developed with materials used for fluid loss control and, among these materials, how they would behave in the loss of fluid.

The document to Ravi et al., entitled "*Cementing Technology for Low Fracture Gradient and Controlling Loss Circulation*", refers to cementing technology for low fracture gradient and controlling loss circulation. Controlling loss of circulation during well construction is more than just selecting the proper type of lost circulation material (LCM). The engineered solution correlates the formation and LCM properties for effective control of losses. In situations where LCM alone may not reduce the losses, the use of chemical sealants such as polymers and special cement systems are discussed. The special cement systems can be designed to meet the specific needs such as acid solubility for easy removal, thixotropy, and filtrate loss.

The document to Yousuf et al., entitled "*A comprehensive review on the loss of wellbore integrity due to cement failure and available remedial methods*", provides a comprehensive review on the loss of well integrity due to cement failure and available remedial methods. Also, the paper provides an extensive review of the underlying reasons of cement failure and the available remedial actions to minimize the loss of well integrity issue. This information is not only useful for understanding the various corrective options available for implementation in the industry, but it also provides a knowledge basis on how to enhance the performance of exiting systems to prevent the issue of cement integrity more efficiently.

The cited state of the art clearly shows that the solutions found are generally based on holistic processes, that is, an analysis is made from the origin of the issue to the impacts it may cause and, from there, actions are proposed to overcome these possible issues in an already existing process. In the present disclosure, the procedures used are aimed at solving most of the issues that may arise during a given process as a whole, minimizing their impacts as much as possible, while in the cited prior arts, the solutions found are directed to a specific problem, yielding a much more limited result than that found in the present disclosure.

Thus, application of the approach disclosed in the present disclosure is effective in achieving the objects of primary cementing of full casing under severe circulation loss conditions, whether in reaching the top of cement within an acceptable range or forming a solid set of barriers to the surface and ensuring cementing quality in hydraulic isolation between zones.

SUMMARY

The present disclosure is intended to provide a method for cementation in carbonate rocks under severe circulation loss conditions comprising the following steps:

Increasing the excess of cement slurry according to the observed lost circulation;

Closing the Blow Out Preventor (BOP) after completion of the displacement to isolate the hydrostatic pressure;

Maintaining pumping flow rate and cement slurry displacement at adequate levels;

Adjusting the circulation temperature for loss of circulation scenarios; and

Using spacers with loss of circulation control.

All actions, despite not altering the equivalent circulation pressure (ECD) during cementation (which would occur in the case of using a liner), proved to be beneficial in fractured carbonate scenarios.

BRIEF DESCRIPTION OF THE FIGURES

FIG. 4 shows the reduction in time to displacement.

DETAILED DESCRIPTION

Figure 1:
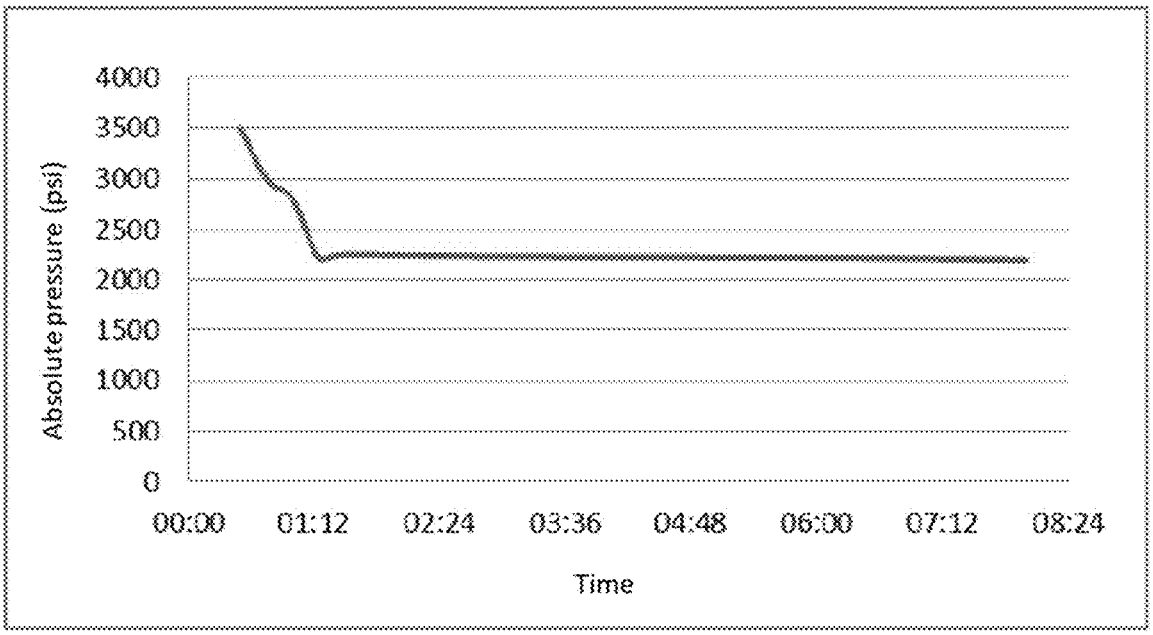
FIG. 1 shows the pressure in the BOP Stack after closing the BOP.

The present disclosure relates to a method for cementing in carbonate rocks under severe circulation loss conditions comprising the following steps:

(a) Increasing the excess of cement slurry according to the circulation loss observed to compensate for the reduced top of cement;

(b) Closing the BOP after completion of cement displacement to isolate hydrostatic pressure;

(c) Maintaining the pumping flow rate and cement slurry displacement at adequate levels;

(d) Adjusting the circulation temperature for loss of circulation scenarios; and (e) Using spacers with circulation loss control.

First, it should be noted that a series of changes were made to the cementing operations of wellbores over the years to improve the results. Also over time, other variables have changed, such as changes in the drilling fluids, field depletion, among others.

(a) Increasing the Excess of Cement Slurry According to the Circulation Loss Observed to Compensate for the Reduced Top of Although it is impossible to precisely predict the top of cement in this scenario, part of the cement volume will be lost to the formation and will prevent the loss during primary cementation. This excess volume must be estimated based on the magnitude of the observed losses, the extent of the exposed formation, among other factors. The "excess" volume over the measured annulus volume (using cable profile data) has proven to be a very useful estimate, as seen in Table 1 below:

TABLE 1

Excess slurry used and differences in the top of cement

| Well | Excess | Predicted Top | Top found | Cementation Losses |
|---|---|---|---|---|
| Well 1 | 50% | 4915 m | 5000 m | 574 bbl |
| Well 2 | 40% | 4911 m | Greater than 5110 m | 26 bbl |
| Well 3 | 50% | 5242 m | Greater than 5440 m | 130 bbl |
| Well 4 | 50% | 5175 m | 5330 m | 531 bbl |
| Well 5 | 50% | 5057 m | 5167 m | 496 bbl |
| **Well 6** | **50%** | **4564 m** | **5220 m** | **861 bbl** |
| Well 7 | 50% | 5010 m | 5085 m | 150 bbl |
| Well 8 | 50% | 4856 m | 4990 m | 920 bbl |
| Well 9 | 50% | 4473 m | 4200 m | 434 bbl |
| **Well 10** | **27%** | **4682 m** | **5160 m** | **391 bbl** |

Not all wells that used this estimate achieved successful primary cementing (wells that were unsuccessful are marked in bold), but it is important to highlight that there has been a significant number of wells that avoided the need for re-cementing due to an increased volume of slurry used.

It is also worth noting that contrary to the practices used in the prior art, the use of increased volumes and excesses of cement slurry in combination with the maintenance of high displacement flow rates contributed to the operational success (in addition to other standard practices such as effective centralization, use of spacers and slurries containing bridging materials, accurate determination of downhole temperature, use of surfactants, and so on, as commonly employed by other operators and by Petrobras).

This methodology of increasing the equivalent pressure by using higher volumes of cement slurry while maintaining high displacement flow rates contradicts conventional practices, in which smaller slurry volumes and heights along with reduced displacement flow rates are considered to contribute to a successful primary cementation. These excess volumes of cement slurry were adjusted based on operations in which severe fluid losses to the formation occurred during primary cementation.

Practices were developed to estimate the excess volume of cement slurry based on the absolute amount of circulation loss measured, as follows: Maximum circulation loss (bph)-excess volume over open hole (%) 0-30%; up to 50-50%; from 51 to 100-75%, greater than 101-100%. By applying these excesses, in cases where spacers and slurries have the effect of sealing the formation, the top of cement will be well above the expected level, imposing on the formation a hydrostatic pressure that it will be unlikely to withstand. Therefore, the risk of cement slurry fall back is huge. In order to prevent these two phenomena, the BOP must be closed immediately upon completion of the displacement, even prior to checking the flowback at the cementing unit.

Then, it is necessary to allow the time required for the cement slurry to gel. During this period, the slurry should lose its fluidity, thereby preventing any further fall back of the top and avoiding invasion by fluids from the formation, hence preserving the quality of the cementation.

The excess cement slurry used in the annular volume depends on the level of losses observed during circulation for cementing. As shown above, for a loss rate of 0 bph, 30% excess is used, for a loss rate of up to 50 bph, a 50% excess is used, for a loss rate between 51 bph and 100 bph, a 75% excess is used, and for losses greater than 101 bph, 100% excess is used.

(b) Closing the BOP after Completion of Cement Displacement to Isolate the Hydrostatic Pressure The second relevant action consisted of preserving the placement of the slurry after completion of the cementing operation without the loss zone continuing to "consume" the cement. Although the Universal Sealing Assembly (USA) is installed immediately after cementing, the time until isolation of the well annulus can be extended, primarily due to cement slurry being still quite fluid. Once the BOP is closed immediately after cementing is completed, the hydrostatic pressure of the fluid above the water depth (WD) is isolated from the well, allowing the entire annular column to reach equilibrium with the pore pressure. The lower the pressure, the lower the loss of slurry to the formation, hence preserving the cement placed at the annulus.

FIG. 1 shows the pressure curve in the BOP Stack (below the ram that was closed) from before closing until the end of the waiting time for the cement to cure. It is noted that the pressure immediately drops, causing the pressure to reach equilibrium with the pore pressure, and shortly afterwards it stabilizes, indicating that the fluid and cement levels in the annulus have stabilized.

In general, the wait-on-cement time with the BOP closed is 12 hours, but this time has recently been reduced to 10 hours in the most recent wells, with no changes in quality.

In instances where the BOP is not closed, the hydrostatic pressure above the BOP is communicated with the open hole. Therefore, the closure of the BOP hydraulically isolates the annular chamber from the casing up to the depth of the BOP, meaning that the annulus is in equilibrium with the open hole. Accordingly, the pressure exerted on the annulus is reduced in relation to the open BOP condition at the end of cementing, which provides an equilibrium condition for the fluids in the annulus. The value of the resulting hydrostatic pressure in the annulus will depend on the height and density of the fluid above the BOP at the end of the cementing operation. It should be noted that cementing of carbonate rocks takes place in water depths close to 2000 m and the drilling fluid has an average density between 9.0 and 12.5 lb/gal.

(c) Maintaining the Pumping Flow Rate and Cement Slurry Displacement at Adequate Levels;

Even under lost circulation conditions, the slurry placement flow rates should remain high to maximize fluid displacement by the spacers and slurry. The benefits of reducing ECD (Equivalent Circulating Density) (an about 500 psi drop for a 50% reduction in the flow rate) are minimal when compared to the damage caused by a poor fluid displacement, since a top of cement below the expected can be relatively simple to correct, whereas a contaminated or channeled cementation may be economically or technically unfeasible to remediate. Each specific scenario may require a specific flow rate program design, depending on the amount of loss, wellbore washout (which reduces the speed of fluids in the annulus).

The displacement flow rate can change depending on pre-operational simulations and is determined based on the results of fluid displacement simulation software. In general, the displacement flow rate ranges from 10 to 14 barrels per minute.

(d) Adjusting the Circulation Temperature for Loss of Circulation Scenarios

Figure 2:
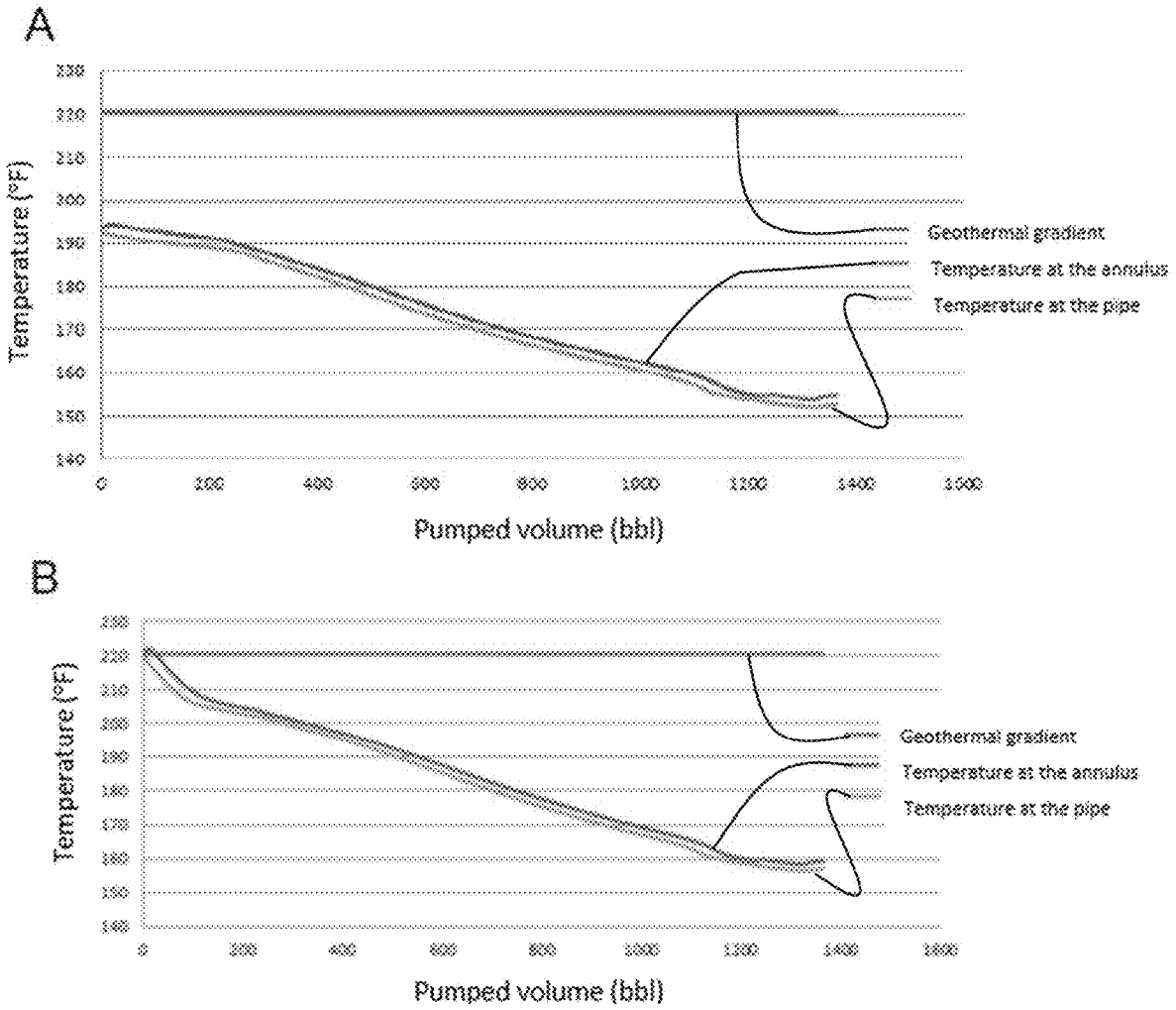
FIG. 2 shows the circulation temperature with (A) and without (B) initial circulation.

As usual practice, in wells with lost circulation, circulation is carried out at lower flow rates to limit the fluid volume loss. As a result, the time for circulation to reach the final temperature (steady state) can be extended. In shallower wells (such as those in the Campos Basin), failing to circulate for cementing may imply the need to adjust the additive concentrations in the slurry or perform sensitivity testing for temperature variations. In Santos Basin, due to the water depth and the depth of the reservoirs, the volumes of circulated drilling fluid are large (in the order of 1000 bbl) and when the slurry enters the annulus, the temperature in the well is already consistent with the temperatures of the slurry tests (for conventional simulations). FIG. 2 shows, for the case presented above (Well 1), the time required for the well to cool under optimal conditions. It further shows the temperature reached in an operation with no prior circulation. It should be noted that although the data for this well is being presented, the same behavior has been observed in the other pre-salt wells.

Thus, as the slurry only enters the annulus after 1200 bbl of pumped fluids, the final temperature is found to be little affected by the impossibility of initial circulation (variation of less than 5° C.). Still remembering that this simulation does not take into account that losses may occur during circulation and pumping.

Figure 3:
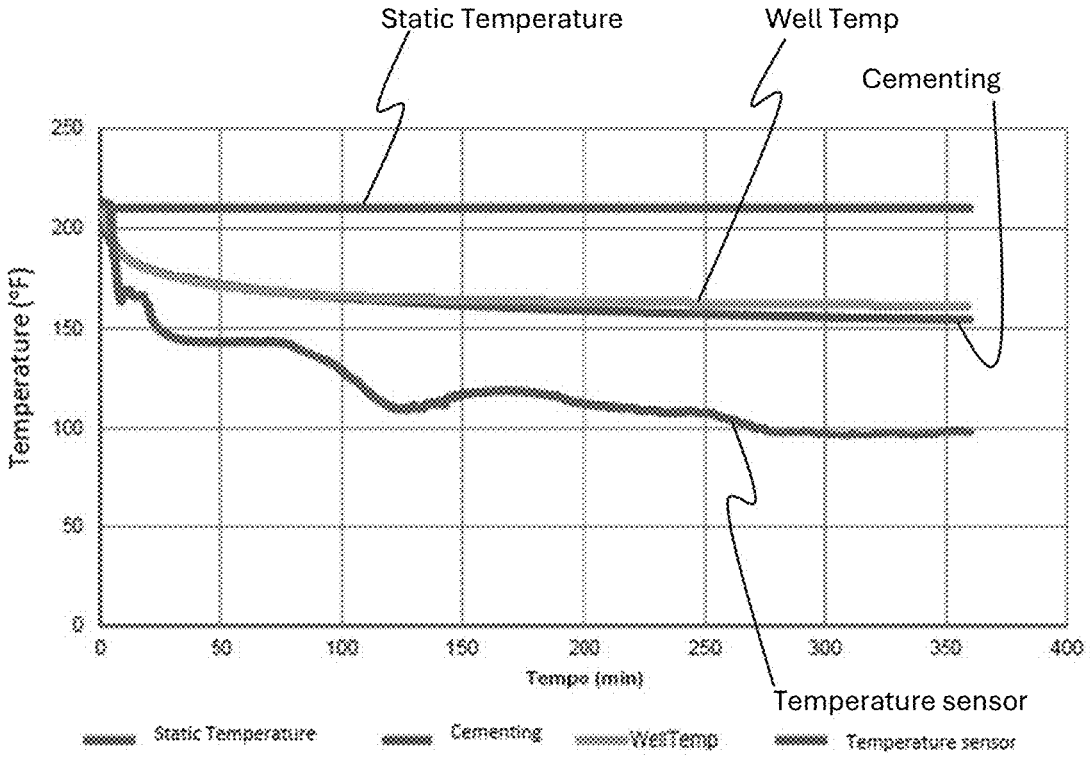
FIG. 3 shows a comparison between circulation temperatures.

As a way of validating the simulations carried out, temperature sensors were run into 2 wells with losses during the open hole conditioning prior to casing running. The objective was to measure both static and circulation temperatures with the drill string, compare with the output data from the simulations and assess whether the slurry tests were adequate to the well conditions. Table 2 and FIG. 3 compare the static temperature, simulated circulation temperature and circulation temperature measured by sensors.

TABLE 2

Temperature measured by sensors run into wells

| Rig | Well | Loss of Circulation | Temperature Sensor | Well Temp Power Law | Cement Power Law |
|---|---|---|---|---|---|
| S1 | Well 11 | NO | 51.1° C. | 55° C. | 54.4° C. |
| S2 | Well 7 | YES | 35° C. | 68.3° C. | 65.6° C. |
| S2 | Well 5 | YES | 36.7° C. | 71.7° C. | 67.8° C. |

When drilling fluid is lost to the rocks, the fluid that is being pumped to the surface is injected into the formations and once it is pumped from the surface, it ends up lowering the temperature to a lower level when compared to the instance in which the fluid is circulated to the bottom of the well and absorbs a higher temperature under the bottom conditions. Table 2 highlights some discrepancies between 30 and 40 degrees Celsius.

Both wells were in a static loss condition that increased with circulation. As can be seen, temperatures are significantly reduced under the circulation condition compared to conventional simulations. This is explained by the reduced back flow, so the fluid at the bottom of the well stops heating the fluid inside the column. This is an important observation as it can significantly change the exposure temperatures of the cement slurry during the process of gaining strength. Depending on the sensitivity of the temperature retarders, variations in thickening time and compressive strength development can be significant. The slurry design is therefore greatly improved when the actual well conditions are known.

(e) Using Spacers with Circulation Loss Control

The spacer has an intermediate density and rheology between the drilling fluid and the cement slurry so that a hierarchy of rheology and density is achieved between the fluids (drilling fluid, spacer and cement slurry), so that the drilling fluid can be displaced by the spacer and the spacer is displaced by the cement slurry. The sealing effect of the spacer also contributes to the cementing operation.

These new technologies have also had an increased use, starting as of 2015. In particular since 2017, they have become part of all reservoir cementing projects in the Santos Basin.

Each service company has its own specific composition, whether fibrous, particulate or granular material, or even a combination thereof. A very interesting piece of work was made by carrying out tests on physical simulators in order to assess the spacers in terms of effectiveness and important operation controls.

Due to the strong sealing nature of the products, it should also be noted that the application conditions also require careful attention, namely:

Cleaning and removal of filters and screens from rig tanks and pumps;

Assessing the absence of plugging zones, as well as the need for prior cleaning of the well (to prevent the risk of plugging);

Use in fluids with support and separation between Newtonian fluids (it may destabilize the fibers and cause plugging); and For the above reason, the use of LCM in wash spacers is also not recommended. This lesson was learned the hard way, resulting in failure to rupture the bottom plug in the wellbore, leading to a critical wellbore re-cementation with severe loss and over 20 days of delay in the wellbore construction.

A side effect of using LCM (Loss control materials) in spacers is to improve the efficiency of displacing the spacers. In the displacement efficiency test, the spacer with LCM was found to require less contact time to provide the same displacement of fluid. FIG. 4 shows the results of this test for 2 BS wells.

Application

The direct application of the aforementioned techniques is in any oil well where the drilling phase goes beyond naturally fractured carbonate rocks and there is a need to run a full casing and its primary cementation.

Expected Advantages

Economic Advantages/Yield

Fifty-eight (58) wells were cemented with severe cement loss, and success was achieved in 95% of them. Some of them notably presented losses of extreme magnitude, but cementing met all the goals without the need for cementing correction, thereby reducing the construction time of each well by 7 to 10 days.

Thus, performing cementing operations in wells with severe loss of circulation is shown to be technically viable as long as the precautions and procedures mentioned in the present disclosure are taken. Understanding the history of operations in wells and related fields is essential for a better planning of the operations, which can be achieved by establishing appropriate contingencies to guide the decision-making process for the best operation based on objective criteria of operational safety and economic factors.

Furthermore, the elimination of long and uncertain plugs to prevent circulation losses in wells prior to casing running, which is also an expensive activity, also represents a considerable cost saving in construction of these wells, given the frequency with which losses occur. Furthermore, as pre-salt fields mature, reservoir depletion tends to render the drilling and cementing conditions of wells increasingly challenging.

Adoption of the MPC technique or even foamed cementation, in addition to indirect costs, could also bring risks, given the uncertainties involved. The use of simpler cementing techniques that have been proven to be safer operationally in deep water scenarios makes the process less uncertain. The use of lesser-known technologies is a barrier that must be overcome. However, as long as the objectives are being met through cost-optimized actions that prioritize operational safety and demonstrate recognized success, these techniques must be maintained. Predicting, in the planning and execution of these wells, contingency cementing correction has therefore proven to be the most cost-effective alternative due to the vast majority of successful cementing quality results.

The invention claimed is:

1. A method for cementation in carbonate rocks under severe circulation loss conditions, the method comprising:

increasing an excess of cement slurry according to a circulation loss observed to compensate for a reduced top of cement;

closing a blow out preventor (BOP) after completion of cement slurry displacement to isolate hydrostatic pressure;

maintaining a pumping flow rate and the cement slurry displacement at effective levels to avoid contaminated cementation or channeled cementation;

adjusting a circulation temperature for loss of circulation scenarios; and using spacers with circulation loss control.

2. The method of claim 1, wherein:

the increased excess of cement slurry is a 30% excess for a circulation loss rate of 0 bph, the increased excess of cement slurry is a 50% excess for a circulation loss rate of up to 50 bph, the increased excess of cement slurry is a 75% excess for a circulation loss rate between 51 bph and 100 bph, and the increased excess of cement slurry is a 100% excess for a circulation loss rate greater than 101 bph.

3. The method of claim 1, wherein:

the method further comprises the spacers displacing a drilling fluid;

the isolated hydrostatic pressure in an annulus depends on a height and a density of a fluid above the BOP after completion of the cement slurry displacement, and the drilling fluid has an average density between 9.0 and 12.5 lb/gal in the cementations of the carbonate rocks in water depths close to 2000 m.

4. The method of claim 1, wherein a flow rate of the cement slurry displacement is in a range of 10 to 14 barrels per minute.

5. The method of claim 1, wherein the method further comprises the spacers displacing a drilling fluid, and wherein the spacers have intermediate density and intermediate rheology between the drilling fluid and the cement slurry.

6. The method of claim 1, wherein the using of the spacers with circulation loss comprises the spacers being displaced by the cement slurry and the spacers displacing a drilling fluid to create a sealing effect.

* * * * *